US005329893A

United States Patent [19]

Drangel et al.

[11] Patent Number: 5,329,893

[45] Date of Patent: Jul. 19, 1994

[54] COMBUSTION ENGINE WITH VARIABLE COMPRESSION RATIO

[75] Inventors: Hans Drangel, Stockholm; Per-Inge Nilsson, Vagnhärad; Lars Bergsten, Järna, all of Sweden

[73] Assignee: SAAB Automobile Aktiebolag, Sweden

[21] Appl. No.: 66,104

[22] PCT Filed: Aug. 23, 1990

[86] PCT No.: PCT/SE91/00817

§ 371 Date: Aug. 3, 1993

§ 102(e) Date: Aug. 3, 1993

[87] PCT Pub. No.: WO92/09798

PCT Pub. Date: Jun. 11, 1992

[30] Foreign Application Priority Data

Dec. 3, 1990 [SE] Sweden ..... 9003835-7

[51] Int. Cl.[5] ..... F02B 75/04

[52] U.S. Cl. ..... 123/78 C; 123/195 C

[58] Field of Search ..... 123/48 L, 78 C, 195 C

[56] References Cited

U.S. PATENT DOCUMENTS 2,770,224 11/1956 Ericson ..... 123/48 C
3,633,552 1/1972 Huber ..... 123/48 R
4,174,683 11/1979 Vivian ..... 123/78 C

OTHER PUBLICATIONS

Patent Abstracts of Japan, vol. 9, No. 142, M388, abstract of JP 60–22030, published Feb. 4 1985 (Mitsubishi Jidosha Kogyo K.K.).

*Primary Examiner*—Noah P. Kamen
*Attorney, Agent, or Firm*—Ostrolenk, Faber, Gerb & Soffen

[57] ABSTRACT

An internal combustion engine (10) is designed with a cylinder section (11) which is pivoted on a crankcase section (13) to provide different compression ratios. The crankcase section (13) is provided with raised lateral walls (21, 22, 24, 25) with upper surfaces (82–85), which lie in the same plane and thereby allow simple assembly of a seal (34) between the cylinder section (11) and crankcase section (13). The lateral walls (21, 22, 24, 25) also enable auxiliary devices for the engine to be easily secured without having to allow for the mobility of the cylinder section (11) relative to the crankcase section (13).

11 Claims, 6 Drawing Sheets

COMBUSTION ENGINE WITH VARIABLE COMPRESSION RATIO

BACKGROUND OF THE INVENTION

This invention relates to an internal combustion engine and, more particularly, to an internal combustion engine having a cylinder section which may be pivoted with respect to the crank case section thereof to vary the compression ratio of the engine.

In engine technology it is known, of prior art, that an engine with a variable compression ratio can improve the efficiency of the engine, particularly when the engine is operated on partial load, enabling the maximum performance of the engine to be increased considerably.

There are a number of different basic solutions for providing adjustment of the compression ratio of an engine. The American patent specification U.S. Pat. No. 2,770,224 describes a piston engine with a fixed crankcase section, to which is hinged a cylinder section, with associated cylinder head. Under is the influence of an eccentric shaft the cylinder section can be pivoted to a greater or lesser degree about a longitudinal shaft, enabling the volume of the combustion chamber to be varied.

In the engine shown the cylinder section is hinged to the crankcase section by means of a hinge shaft which may also be regarded as constituting a central shaft for the engine camshaft. This is advantageous because the mechanism for controlling the engine valves by means of the camshaft, and in this case also push rods, is not therefore appreciably affected by the fact that the cylinder section is hinged.

Although an engine of this design may be regarded as favourable from the point of view of combustion, it nevertheless suffers from several disadvantages which limit its potential for practical application.

The possibilities of arranging a perfect seal between the cylinder section and the crankcase section are limited. Because the divisions between the two sections extend in different planes around the periphery of the engine, it is necessary to arrange seals which also extend in the vertical direction of the engine. On one side of the engine the seals will be subjected to torsional forces, whilst the seals on the other side are subjected to combined tens le and bending stresses. There is no suitable material for simultaneously meeting these requirements, but it is probably necessary to arrange such types of seals at different points along the divisions. This in turn creates problems in connecting the seals to each other. A good seal between the cylinder section and the crankcase section is essential both for preventing the ingress of dirt in the crankcase and for preventing oil and/or gases present in the crankcase from leaking out.

Internal combustion engines for vehicle use are also used to drive a number of different auxiliary units, e.g. generator, servo pumps, compressor and water pump. In engines with a fixed compression ratio these components are secured to the cylinder section of the engine by means of various brackets, and are driven by the crankshaft of the engine by means of belt transmissions. In an engine with a moving cylinder section this is not possible unless complicated arrangements are provided for their drive. The above-mentioned patent specification U.S. Pat. No. 2,770,224 does not provide a solution for arranging this in practice either.

In an engine for vehicle use the output shaft of the engine is connected by a clutch to a gearbox. The possibilities in practice of arranging a flange plane for securing a clutch case or gearbox to one end of the engine are similarly limited if the cylinder section of the engine is moving. Internal combustion engines for use other than in vehicles present similar problems.

SUMMARY OF THE INVENTION

The object of this invention is to eliminate this problems in an engine of the type described above. The object of the invention is therefore to provide a good seal between the cylinder section and crankcase section of an engine with a variable compression ratio. A further object is to enable auxiliary units to be mounted and arranged simply on the engine and to enable a simple layout for the drive thereof. Similarly, a further object is to enable a conventional flange plane to be used for securing the clutch case and gearbox to the crankcase section of the engine.

According to the invention these objects are achieved by an internal combustion engine having a cylinder section pivotably mounted to the crankcase section thereof. The cylinder section is enclosed by vertically extending lateral walls connected to or integral with the crankcase section and having respective upper surfaces which lie essentially in the same plane. A seal is arranged between the upper surfaces and the cylinder section to provide a seal between the cylinder and crankcase sections.

By designing the crankcase section of the engine according to the invention, with raised lateral walls along both sides of the engine, and by connecting these sides at both ends of the engine, possibilities are provided for securing a seal in the same plane. This enables a good seal to be provided. The design of the fixed lateral walls of the crankcase section also enables auxiliary crankshaft driven components to be secured and arranged easily by essentially conventional means, even when the cylinder section is movable relative to the crankcase section.

Further features and advantages characterising the invention are indicated in the following description of an advantageous embodiment.

BRIEF DESCRIPTION OF THE DRAWINGS

The description is given with reference to the attached drawings, in which.

DESCRIPTION OF THE PREFERRED EMBODIMENT

Figure 1:
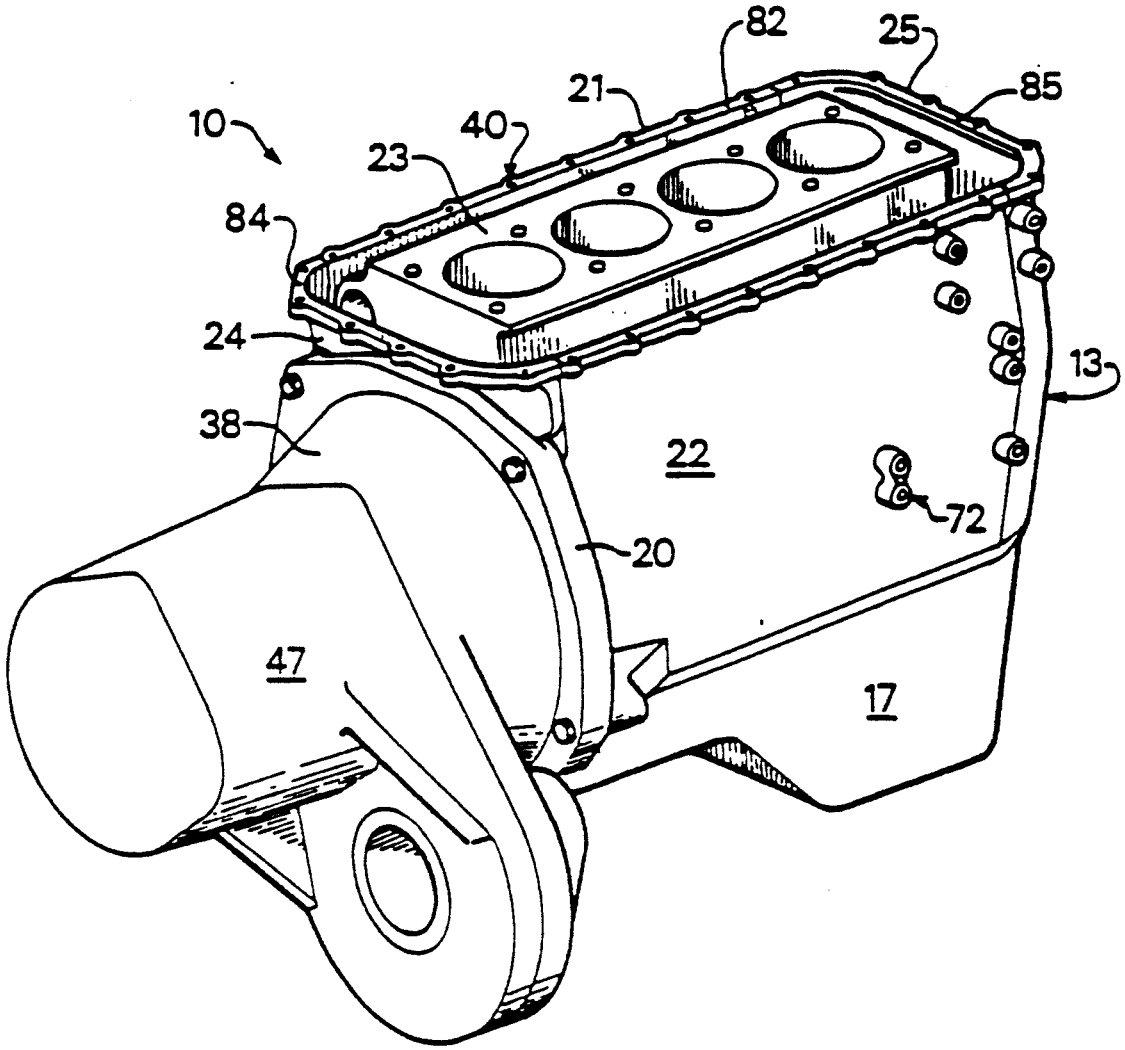
FIG. 1 shows a perspective view of the basic construction of the engine

The embodiment is described with reference to a multiple cylinder internal combustion engine of the Otto type, intended for use in a vehicle such as a passenger car. The attached FIG. 1 shows in perspective the basic construction of engine 10, in which a number of components, although essential, have been removed to improve the clarity of the figure. FIGS. 2–3 show engine 10 in more detail, but do not show the complete engine.

Engine 10 incorporates a cylinder section 11, in this case with four cylinders 12 arranged in line. Engine 10 also includes a crankcase section 13 housing crankshaft 14 of engine 10 and its bearings. Each cylinder 12 houses a piston 15 which is connected by a connecting rod 16 to crankshaft 14. Engine 10 conventionally incorporates an oil sump 17 secured to the bottom of crankcase section 13.

Figure 2A:
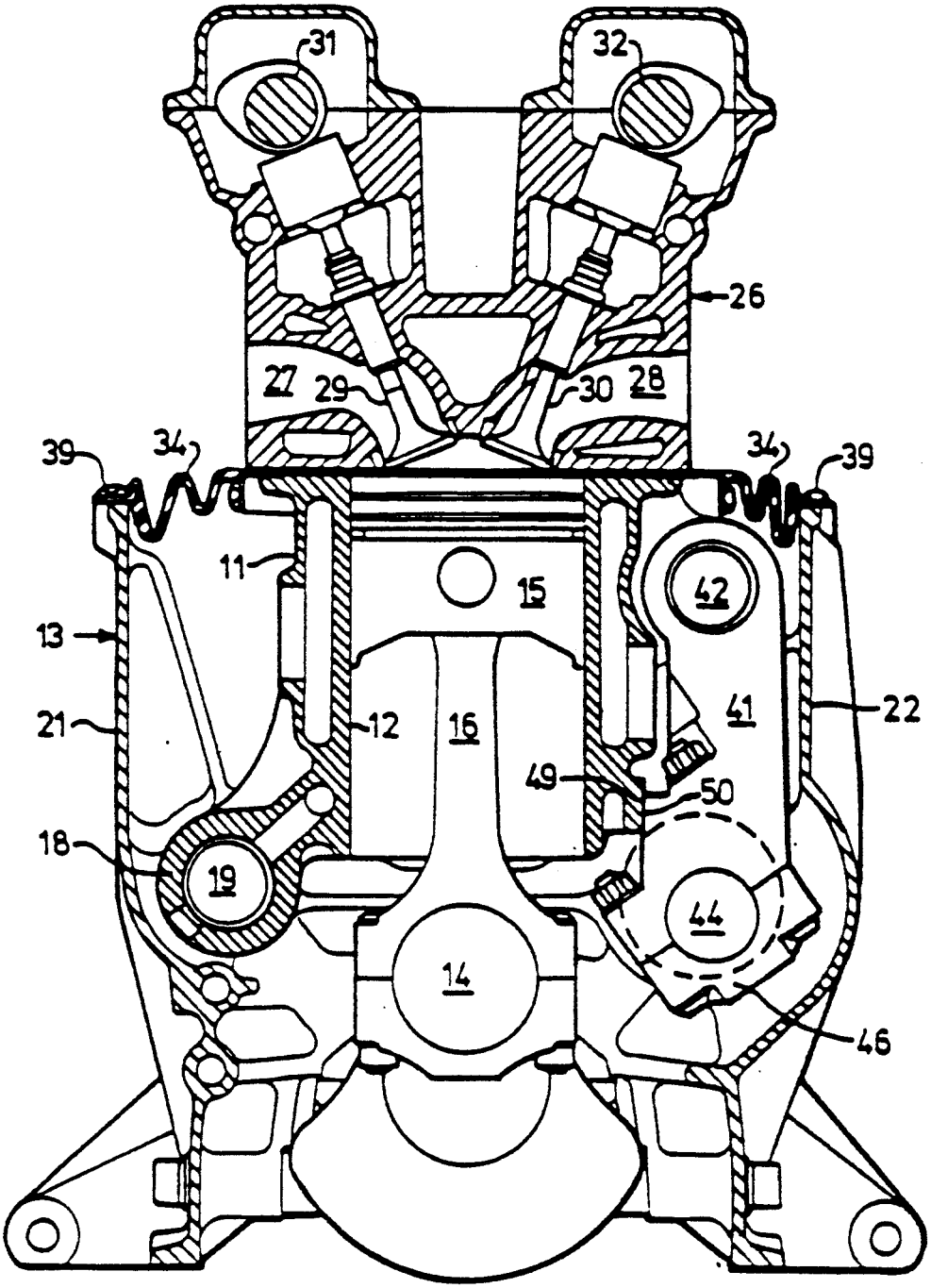
FIG. 2*a* shows a vertical cross-sectional view of the engine in a position for maximum compression.
Figure 2B:
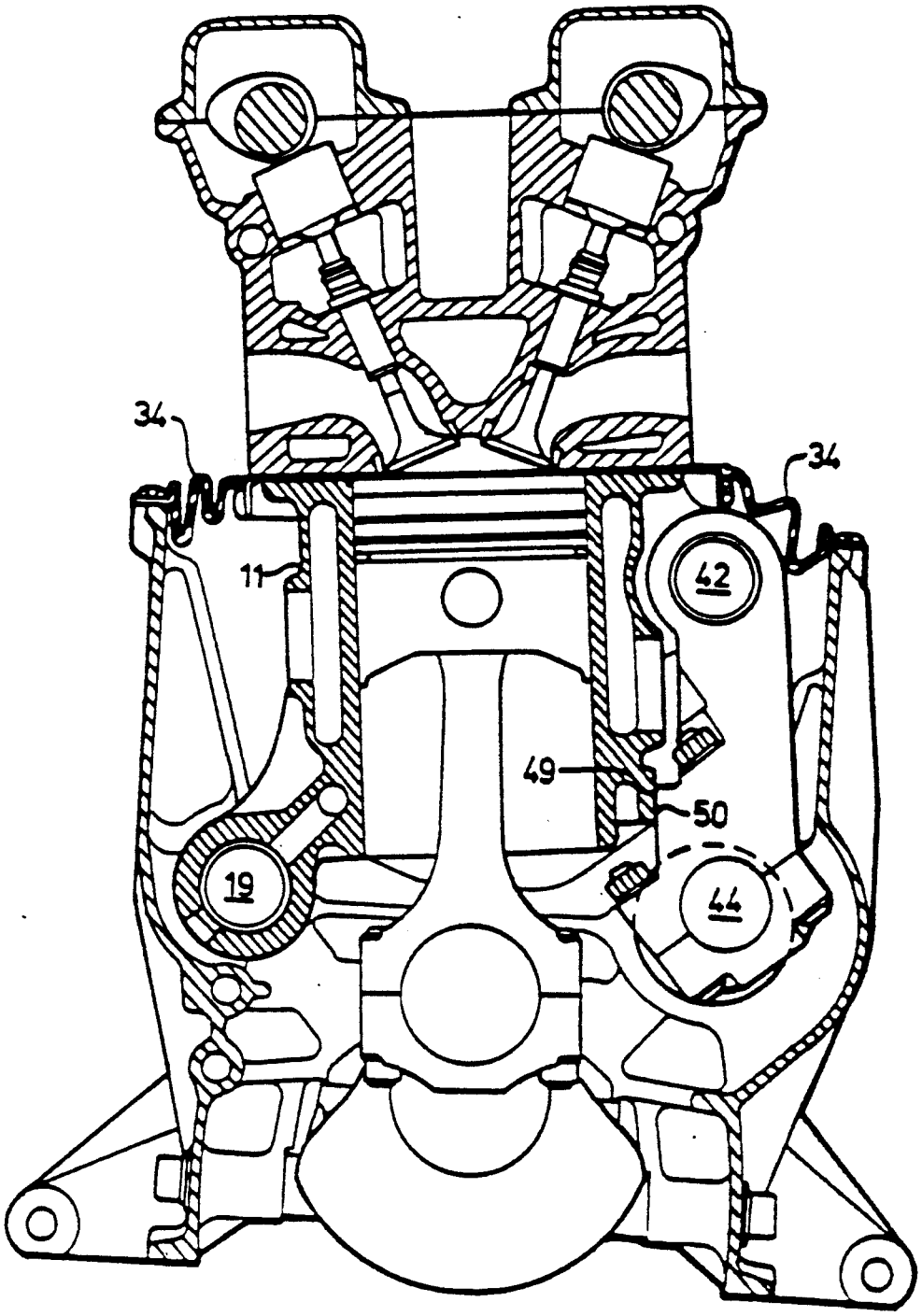
FIG. 2*b* shows a vertical cross-sectional view of the engine in a position for minimum compression.
Figure 3:
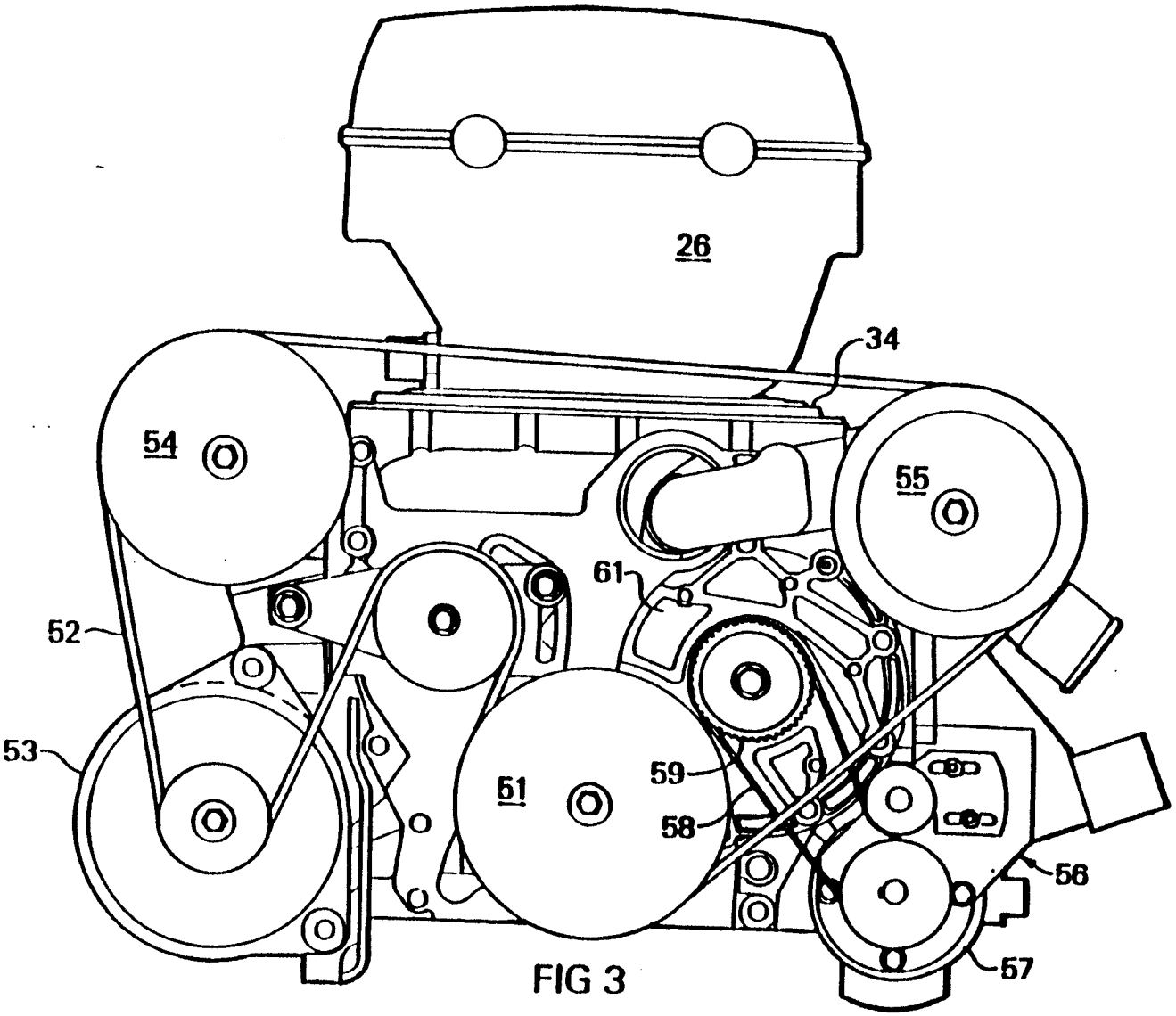
FIG. 3 shows a front view of the engine.

Along one of its sides, on the left-hand side in FIGS. 2–3, cylinder section is provided at its lower end with four bearing lugs 18, only one of which is shown in FIG. 2*a*, in which lug extends a shaft 19 housed in five bearing brackets secured to crankcase section 13. This arrangement enables cylinder section to be tilted about this shaft 19 relative to crankcase section 13. Because crankshaft 14 and engine pistons 15 connected to it are mounted in crankcase section 13, whilst the distance to cylinder section 11 can be varied, the compression ratio of engine 10 can also be varied.

FIG. 2*a* shows engine 10 in a position where cylinder section 11 is tilted to the minimum degree about shaft 19, and where engine 10 exhibits a maximum compression ratio. Correspondingly FIG. 2*b* shows a position in which cylinder section 11 is titled to the maximum degree about shaft 19, and hence engine 10 is in a position for a minimum compression ratio. FIGS. 2*a* and 2*b* are otherwise identical.

In view of the transverse forces exerted by pistons 15 of engine 10 against the respective cylinder walls, it is advantageous, or at least a good compromise solution, for hinge shaft 19 to be arranged at a relatively low height relative to engine crankshaft 14. Crankcase section 13 is also designed with integrated, vertically raised lateral walls 21, 22 on both sides of cylinder section 11. In this case lateral walls 21, 22 extend vertically to a level which corresponds essentially to the upper end face 23 of cylinder section 11. At one end of engine 10, in this case the rear end, is arranged a mountable gear case 24, and at the other front end is arranged a mountable end plate 25, both of which also constitute lateral walls. End plate 25 and gear case 24 connect the two lateral walls 21, 22 secured to the crankcase section. End plate 25 and gear case 24 also extend vertically to a level corresponding essentially to the upper end face 23 of cylinder section 11. This means that upper end faces 82–85 on lateral walls 21, 22, end plate 25 and gear case 24 will lie in the same plane, which plane also corresponds essentially to the upper end face 23 of cylinder section 11. This upper end face 23 may of course consist of an imaginary plane in an engine in which cylinder section 11 and cylinder head 26 are integral engine components, and where the imaginary plane lies essentially in the transition between the walls and roof of the cylinder. Lateral walls 21, 22, gear case 24 and end plate 25 will therefore enclose cylinder section 11 around its periphery. In this embodiment upper end faces 82–85 on lateral walls 21, 22, gear case 24 and end plate 25 also constitute the upper edges of the respective components. In alternative embodiments it is sufficient for the respective components 21, 22, 24, 25 to be designed with similar surfaces which need not at the same time be edges.

In an alternative embodiment it is possible for the lateral walls 21, 22 to be mountably secured to crankcase section 24 instead of forming integral parts of the same.

As shown in FIG. 1 gear case 24 is designed with a flange 20 to which is secured a clutch case 38 housing a clutch connected to the output shaft of engine 10. A gearbox 47, of intrinsically conventional design, is secured to clutch case 38. Clutch case 38 and gearbox 47 also house a final drive which transmits outgoing driving force to the drive shafts (not shown). The drive shafts are arranged to extend parallel with engine 10 and on both sides of clutch case 38/gearbox 47, which means that the vehicle is one with a transverse mounted engine. A cylinder head 26, with inlet and outlet ducts 27, 28, inlet and outlet valves 29, 30 and two overhead camshafts 31, 32, is secured to the top 23 of cylinder section 11. Inlet and outlet ducts 27, 28 are connected to normal arrangements (not shown), e.g. inlet and outlet systems and associated devices for fuel injection, superchargers, exhaust cleaning arrangements.

Figure 5:
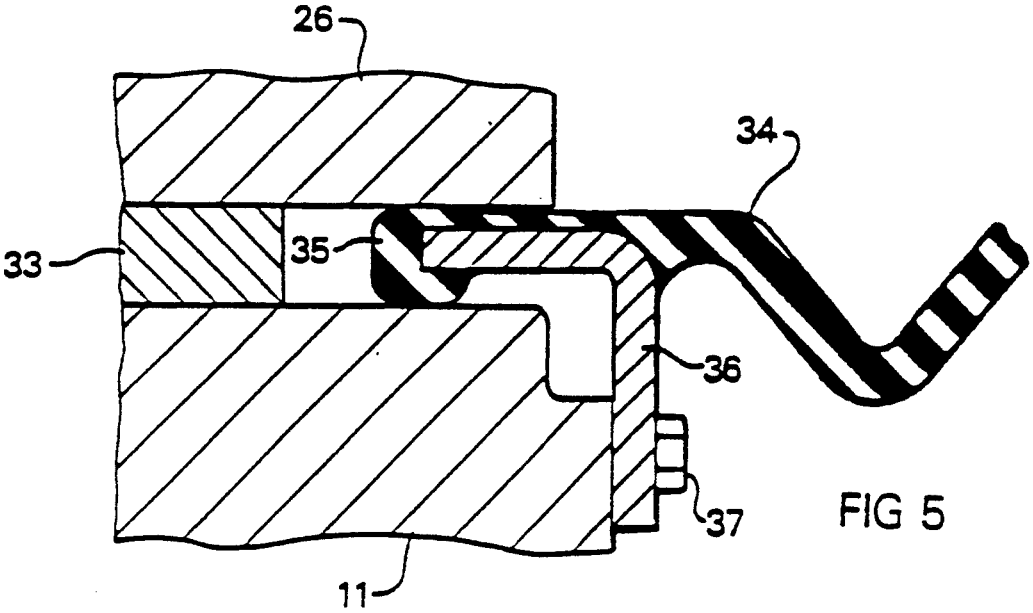
FIG. 5 shows a cross-sectional view of parts incorporated in a sealing arrangement.

A cylinder head gasket (FIG. 5) is arranged between cylinder head 26 and cylinder section 11 of engine 10, and an elastic seal 34, which extends round the entire cylinder section 11, is arranged between cylinder section 11 of engine 10 and the surrounding lateral walls 21, 22, gear case 24 and endplate 25. Seal 34 is designed for sealing the crank case of engine 10. Seal 34 is advantageously designed with a bellows-shaped cross-sectional shape, which means that it can be moved in its own plane, can be set at an angle and can provide different vertical positions for different parts of seal 34. As shown in greater detail in FIG. 5, seal 34 is also pressed tight, so that it seals on its inner edge 35, between cylinder head 26 and cylinder section 11. Because cylinder head gasket 33 is almost completely rigid, elastic seal 34 is prevented from being compressed excessively between cylinder head 26 and cylinder section 11. Seal 34 is also retained by a holder 36 which is secured, by means of bolted joint 37, to cylinder section 11 and which holder 36 is cast into seal 34. In the embodiment shown holder 36 is bent at an angle, but other shapes are also conceivable.

Where cylinder section 11 and cylinder head 26 are manufactured as one integral engine component, so-called monobloc design, inner edge 35 of seal 34 can be pulled round an unbent holder 37 so that bolted joint 37 and the holder clamp seal 34 against the side of the monobloc.

A plate edge, which is secured by means of a number of bolted joints 39 so that it seals against the upper ends of lateral walls 21, 22, end plate 25 and case 24, is cast in at the outer edge of seal 34. For this purpose these end faces are designed with mounting holes 40.

Figure 4:
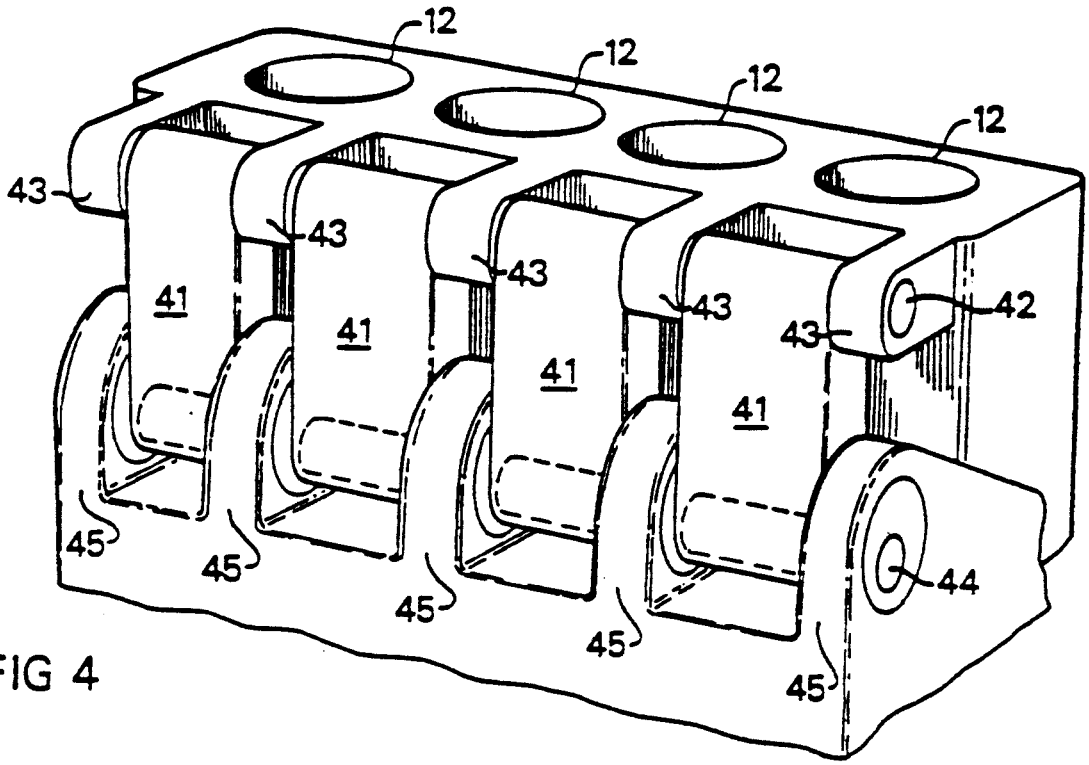
FIG. 4 shows a perspective and detailed view of an arrangement for varying the compression of the engine.

On bearing shaft 19, opposite side of cylinder 11, on the right-hand side in FIGS. 2*a* and 2*b* are arranged four rods 41, resembling connecting rods, which are shown diagrammatically in FIG. 4. Rods 41 are mounted, at their respective upper ends, on a longitudinal shaft 42, which is in turn mounted in five bearing brackets 43 secured to the cylinder section. Rods 41 are mounted eccentrically at their respective lower ends on an eccentric shaft 44, which is housed in five bearing brackets 45 secured to the crankcase section. The five bearing brackets 43 secured to the cylinder section are arranged longitudinally at the ends of cylinder section 11 and in the area between cylinders 12, where cylinder section 11 has a relatively high degree of rigidity.

Rods 41 are designed at their lower ends with separate bearing caps 46, (FIG. 2*a*) which provide simple mounting and removal of the same relative to eccentric shaft 44. At the front end of eccentric shaft 44 is secured a driving wheel running in a transmission, enabling eccentric shaft 44 to rotate. Eccentric shaft 44 can be rotated approximately half a revolution maximum, corresponding to the maximum stroke of rod 41, and also corresponding to the interval within which the compression of engine 10 can be varied. Rods 41 interact with stops 49 provided on the side of cylinder section 11, so that lateral faces 50 on the respective rods 41 rest against stops 49 in both limit positions of eccentric shaft 44. By arranging such a dimensionally stable limitation of the rotation of eccentric shaft 44 it can be positioned close to cylinder section 11 in the lateral direction. This gives engine 10 a compact design.

As shown in FIG. 3 a pulley 51, secured to the front end of crankshaft 14, is used to drive different auxiliary devices for engine 10 with a common driving belt 52, such as generator 53, power steering pump 54 and water pump 55. All these auxiliary devices 53–55 are secured to crankcase section 13 of engine 10 by means of ordinary brackets secured to the raised lateral walls 21,22. For this purpose lateral walls 21,22 are provided on their outsides with fastening holes 72, some of which are shown in FIG. 1, or equivalent, which enable auxiliary devices 53–55 to be secured conventionally by means of bolted joints. An electric motor 57, which drives a toothed pulley 59 via a toothed belt 58, and a gear wheel rigidly connected to it (not shown), is also secured to crankcase section 13 by a bracket 56. This gear wheel, together with an internal gear wheel, form a drive housed in a recess in gear case 24, covered by a cover 61. The internal gear wheel also constitutes a driving wheel for eccentric shaft 44. Such a drive, with a gear wheel arranged inside a wheel with inner teeth, is well known in itself and is called, among other things, a harmonic drive. By designing the gear wheel with a certain number of teeth, and in designing the inner gear wheel with only one additional tooth, a drive with a high gear reduction is obtained. When the gear wheel has been rotated one revolution, the inner gear wheel has rotated at an angle corresponding to one tooth. The inner gear wheel and eccentric shaft 44 rigidly connected to it can therefore be rotated with high precision by means of electric motor 57. In this embodiment eccentric shaft 44 can be rotated half a revolution maximum, sufficient for rods 41 to tilt cylinder section 11 to the maximum or minimum degree relative to crankcase section 13, which also corresponds to the minimum and maximum compression ratio of engine 10 respectively.

Figure 6:
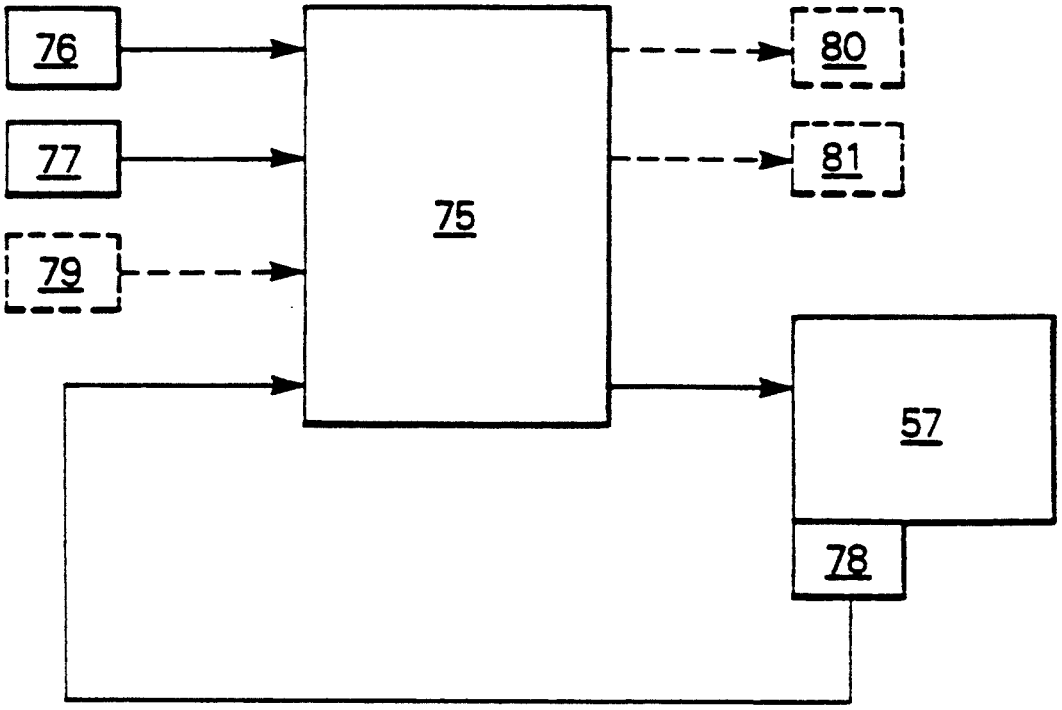
FIG. 6 is a schematic wiring diagram of an electrical control system for controlling the engine compression.

FIG. 6 shows diagrammatically an electric control system for controlling electric motor 57, and hence also for controlling the compression ratio of engine 10. A microprocessor-based control unit 75 is connected to a sensor 76 in the inlet system of engine 10, and receives via this sensor a signal representing the pressure in the inlet system. This pressure is a measure of the load of engine 10. Control unit 75 is also connected to a sensor 77, which transmits a signal to the control unit representing the speed of rotation of crankshaft 14, i.e. the speed of engine 10. On the basis of these engine parameters and setpoints stored in memory circuits in control unit 75 for a required compression ratio control unit 75 transmits an output signal to electric motor 57 to assume a certain position of rotation. In this case eccentric shaft 44 is caused by the above-mentioned transmission to assume a corresponding position of rotation, cylinder section 11 being rotated about bearing shaft 19 and the required compression ratio obtained.

As mentioned above eccentric shaft 44 can only be rotated about half a revolution, whist in order to achieve this electric motor 57 must be rotated several revolutions. A position sensor 78, sensing the relative position of rotation of eccentric shaft 44, is arranged on eccentric shaft 44 and is fed back to control unit 75 to transmit a signal corresponding to the position of rotation of eccentric shaft 44, and hence indirectly also the compression ratio of engine 10. Such a position sensor may, for example, be designed as a potentiometer.

In more advanced embodiments of the invention control unit 75 and sensors 36, 77 may be incorporated in larger units for controlling engine 10, and need not therefore consist of separate components or be arranged only for controlling electric motor 57, as exemplified above.

Where the engine is controlled by means of an electrically controlled throttle 79 this can be connected to control unit 75 to transmit a signal for calculating the required compression ratio instead of the two sensors 76, 77 for inlet pressure and engine speed. This is denoted by dashed lines in FIG. 6, which also indicates, by dashed lines that control unit 75 can be used to transmit control signals to ignition system 80 of the engine and, in this case, to supercharging system 81 of the engine for controlling further is engine parameters.

Because the compression ratio of engine 10 can be controlled in the manner described, the engine can be operated, even at partial load, so that a high compression is obtained. The advantage of this is improved thermal efficiency and reduced fuel consumption. The engine should, advantageously, be of the supercharged type, which means that the compression can be varied over a wide operating range. Control unit 75 can therefore be designed advantageously so that it also controls supercharging unit 81 of engine 10.

Depending on control signals from control unit 75 electric motor 57 will therefore rotate eccentric shaft 44 so that cylinder section 11, under the influence of rods 41, will cause cylinder section 11 to assume a certain angle relative to crankcase section 13, thereby giving engine 10 a certain appropriate compression ratio.

In connection with these relative movements between cylinder section 11 and crankcase section 13, seal 34 is subjected to both tension, pressure and torsion. Because seal 34 is secured along its outer edge to the same plain, because its inner edge 35 lines in another plane, and because both these plains lie essentially in the same plane, or at least close to each other, seal 34 is still not subjected to any major stresses. The intrinsic elasticity of seal 34, together with the folded bellows shape, enables it to absorb and follow the relative movements which take place between cylinder section 11 and crankcase section 13.

Seal 34 may be designed as an integral unit which both facilitates assembly and ensures good sealing. In an alternative embodiment seal 34 may also be conceivably made integral with cylinder head gasket 33.

The possibilities of achieving a good seal by this method are dependent on the design of lateral walls 21,22, end plate 25 and gear case 24. This design also enables auxiliary devices 53–55, driven by crankshaft 14, to be secured easily to engine 10 without having to allow for the fact that cylinder section 11 is movable relative to crankshaft section 13.

The invention is not limited by the embodiment described but can also be used to advantage in a number of other modified embodiments within the scope of the attached patent claims.

We claim:

1. An internal combustion engine having a variable compression ratio, which comprises:

a crankcase section;

a cylinder section pivotably mounted on the crankcase section, the crankcase section having a plurality of vertically extending lateral walls which enclose the cylinder section, the lateral walls having respective upper surfaces which lie essentially in the same plane; and a seal arranged between the upper surfaces of the lateral walls and the cylinder section to provide a seal between the crankcase section and the cylinder section.

2. An internal combustion engine according to claim 1, further including a cylinder head secured to the cylinder section and wherein the upper surfaces of the lateral walls lie essentially at the same level as a plane of division between the cylinder section and the cylinder head.

3. An internal combustion engine according to claim 2, further including: a rigid holder for the seal, the seal having an inner edge which is secured to the holder; and means for securing the holder to the cylinder section.

4. An internal combustion engine according to claim 3, wherein the holder securing means includes at least one bolt.

5. An internal combustion engine according to claim 1, wherein the seal has an inner edge which is clamped between the cylinder section and the cylinder head to seal the cylinder section to the cylinder head.

6. An internal combustion engine according to claim 1, wherein the seal extends about the periphery of the cylinder section and has a peripheral portion with a substantially bellow-like shape.

7. An internal combustion engine according to claim 1, wherein the lateral walls comprise a pair of opposing side walls and a pair of opposing end walls, the end walls being removable connected to the crankcase section.

8. An internal combustion engine according to claim 7, wherein: the side walls are integral with the crankcase section; at least one of the end walls is a gear case; and means are provided for securing the gear case to the crankcase section.

9. An internal combustion engine according to claim 8, wherein the mounting means for the gear case includes at least one bolt.

10. An internal combustion engine according to claim 7, wherein the side walls are provided with means for enabling auxiliary devices to be mounted on the crankcase section.

11. An internal combustion engine according to claim 10, wherein the enabling means includes a plurality of holes in the side walls.

* * * * *